US006758173B2

(12) United States Patent
Saito et al.

(10) Patent No.: US 6,758,173 B2
(45) Date of Patent: Jul. 6, 2004

(54) COOLING STRUCTURE IN ENGINE

(75) Inventors: Junya Saito, Wako (JP); Kentaro Nonaka, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 90 days.

(21) Appl. No.: 10/267,042

(22) Filed: Oct. 9, 2002

(65) Prior Publication Data

US 2003/0079265 A1 May 1, 2003

(30) Foreign Application Priority Data

Oct. 10, 2001 (JP) ..... 2001-348079

(51) Int. Cl.[7] ..... F02B 75/18

(52) U.S. Cl. ..... 123/41.74; 123/41.57; 123/41.72

(58) Field of Search ..... 123/41.74, 41.72, 123/41.67, 41.57, 41.82 R

(56) References Cited

U.S. PATENT DOCUMENTS 6,412,451 B2 * 7/2002 Kuga et al. ..... 123/41.72

FOREIGN PATENT DOCUMENTS

JP 10-37799 2/1998

* cited by examiner

*Primary Examiner*—Tony M. Argenbright
*Assistant Examiner*—Katrina B. Harris
(74) *Attorney, Agent, or Firm*—Armstrong, Kratz, Quintos, Hanson & Brooks, LLP.

(57) ABSTRACT

In an engine of a cylinder-head first cooling type, cooling performance for a cylinder head and a cylinder block is enhanced. Cooling water from a water pump is supplied via a water jacket in a cylinder head to a water jacket in a cylinder block. The water jacket in the cylinder head is defined to extend along opposite sides of a plurality of cylinders disposed in a row, and has a cooling-water inlet and a cooling-water outlet provided at lengthwise one end thereof and the lengthwise other end thereof, respectively. The water jacket in the cylinder block is defined to surround outer peripheries of the plurality of cylinders disposed in the row, and is shielded at one point by a shield member, and has a cooling-water inlet provided on one side of the shield member to communicate with the cooling-water outlet in the water jacket.

6 Claims, 5 Drawing Sheets

COOLING STRUCTURE IN ENGINE

BACKGROUND OF THE INVENTION

1. Field of the Invention

The present invention generally relates to a cooling structure in an engine, in which cooling water from a water pump is supplied via a water jacket in a cylinder head to a water jacket in a cylinder block.

2. Discussion of the Relevant Art

There is a cooling structure in an engine known from Japanese Patent Application Laid-open No. 10-37799, in which a projection for making cooling water difficult to flow is formed in a portion of a water jacket defined to surround outer peripheries of a plurality of cylinders disposed in a row in a cylinder block so that the cooling water flows in substantially one direction toward the projection within the water jacket by supplying the water jacket from the water pump to one side of the projection, thereby enhancing the cooling effect.

In an engine of a so-called cylinder-head first cooling type, in which cooling water from a water pump is supplied via a water jacket in a relatively high-temperature cylinder head to a water jacket in a relatively low-temperature cylinder block, if the cooling water supplied to the cylinder head flows into the cylinder block before sufficiently cooling the cylinder head, there is a possibility that the cooling of the cylinder head is insufficient. In addition, if the cooling water does not flow smoothly in one direction in the water jacket in the cylinder block, there is a possibility that the cooling of the cylinder block is also insufficient.

The present invention has been accomplished with such problems in mind. It is thus an object of the present invention to enhance the cooling performance for the cylinder head and the cylinder block in the engine of the cylinder-head first cooling type.

SUMMARY OF THE INVENTION

In order to achieve the above object, according to a first embodiment of the present invention, there is proposed a cooling structure in an engine, in which cooling water from a water pump is supplied via a water jacket in a cylinder head to a water jacket in a cylinder block, wherein the water jacket in the cylinder head is defined to extend along opposite sides of a plurality of cylinders disposed in a row, and has a cooling-water inlet and a cooling-water outlet provided at lengthwise one end thereof and the lengthwise other end thereof, respectively. The water jacket in the cylinder block is annularly defined to surround outer peripheries of the plurality of cylinders disposed in the row, and is shielded at one point by a shield member, has a cooling-water inlet provided on one side of the shield member to communicate with the cooling-water outlet in the water jacket in the cylinder head, and has a cooling-water outlet provided in the other side of the shield member.

With the above structural arrangement, the cooling water from the water pump flows from the cooling-water inlet in the one end to the cooling-water outlet in the other end of the water jacket defined to extend along the opposite sides of the plurality of cylinders in the cylinder head. The cooling water is then supplied to the cooling-water inlet provided on one side of the shield member in the water jacket annularly defined in the cylinder block to surround the outer peripheries of the cylinders, and flows therefrom to the cooling-water outlet on the other side of the shield member.

Therefore, the cylinder head having a relatively high temperature during operation of the engine is first cooled by a lower-temperature cooling water; and the cylinder block having a relatively low temperature is then cooled by the cooling water, whereby the cooling effect for the entire engine can be enhanced. More particularly, a substantially total amount of the cooling water flows over the entire region of the water jacket provided annularly in the cylinder block, leading to an enhancement in cooling effect for the cylinder block.

According to a second embodiment of the present invention, in addition to the arrangement of the first embodiment, in the water jacket in the cylinder block, its portion upstream in a direction of flow of the cooling water is disposed to extend along a side face of the cylinder block on an intake side, and its portion downstream in the direction of flow of the cooling water is disposed to extend along a side face of the cylinder block on an exhaust side.

With the above structural arrangement, the upstream portion of the water jacket provided annularly in the cylinder block is disposed to extend along the side face of the cylinder block on the intake side, and the downstream portion is disposed to extend along the side face of the cylinder block on the exhaust side. Therefore, the side face of the cylinder block on the intake side can be preferentially cooled, whereby a deterioration of intake efficiency can be minimized.

According to a third embodiment of the present invention, in addition to the arrangement of the first and second embodiments, the cooling-water outlet of the water jacket in the cylinder block communicates with a heater core through cooling-water passages defined in the cylinder block and the cylinder head.

With the above structural arrangement, the cooling water exiting from the cooling-water outlet of the water jacket in the cylinder block is supplied to the heater core through the cooling-water passages defined in the cylinder block and the cylinder head. Therefore, the cooling water which has cooled both the cylinder head and the cylinder block to obtain a sufficiently raised temperature, can be supplied to the heater core, thereby enhancing the heating effect.

According to a fourth embodiment of the present invention, in addition to the arrangement of the third embodiment, a portion of the cooling-water passage communicating with the heater core is used commonly as a cooling-water passage for supplying the cooling water to a radiator.

With the above arrangement, the cooling-water passage communicating with the heater core is partially used commonly as the cooling-water passage for supplying the cooling water to the radiator, which can contribute to an enhancement in space efficiency.

According to a fifth embodiment of the present invention, in addition to the structural arrangement of any of the first to fourth embodiments, the water jacket in the cylinder head and the cooling-water passage communicating with the heater core are connected to each other by a cooling-water passage having an orifice.

With the above structural arrangement, because the water jacket in the cylinder head and the cooling-water passage communicating with the heater core are connected to each other by the cooling-water passage having the orifice, when the engine is hot, even if the amount of the cooling water flowing in the radiator increases and the amount of the cooling water flowing in the heater core decreases, the heating ability can be maintained by supplying the cooling water from the water jacket in the cylinder head through the orifice directly to the heater core.

According to a sixth embodiment of the present invention, in addition to the structural arrangement of any of the first to fifth embodiments, the water jacket in the cylinder head and the water jacket in the cylinder block are put into communication with each other by communication bores defined between opposed portions of the adjacent cylinders.

With the above structural arrangement, because the water jackets in the cylinder head and the cylinder block are put into communication with each other by the communication bores defined between the opposed portions of the adjacent cylinders, the opposed portions of the adjacent cylinders liable to have a high temperature can be cooled, but also the flow rate of the cooling water flowing in the water jacket in the cylinder when the engine is cold, can be decreased to promote the warming-up of the engine.

DETAILED DESCRIPTION OF THE PREFERRED EMBODIMENTS

The mode for carrying out the present invention will now be described by way of an embodiment of the present invention shown in the accompanying drawings.

Figure 1:
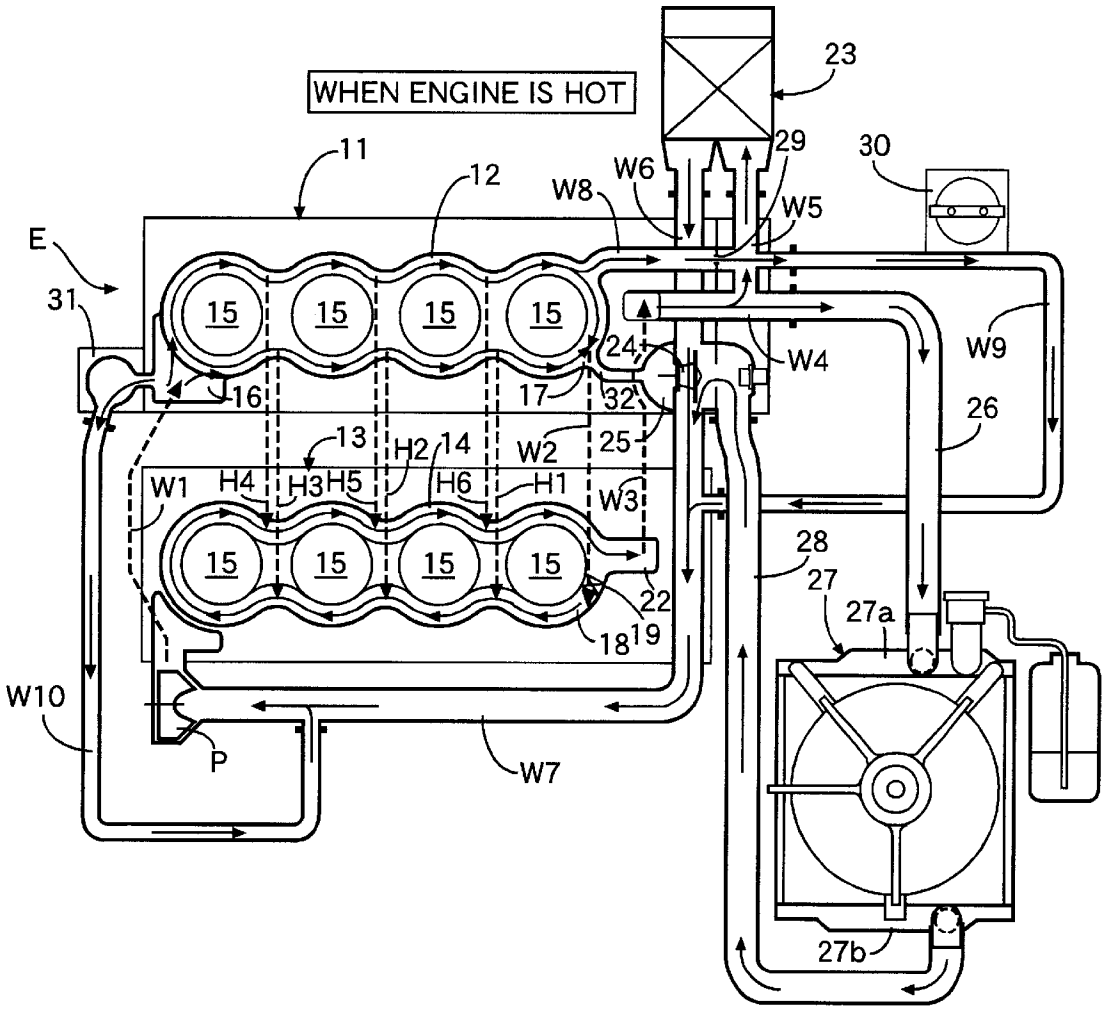
FIG. 1 is a circuit diagram of cooling-water passages in an engine during opening of a thermostat.
Figure 2:
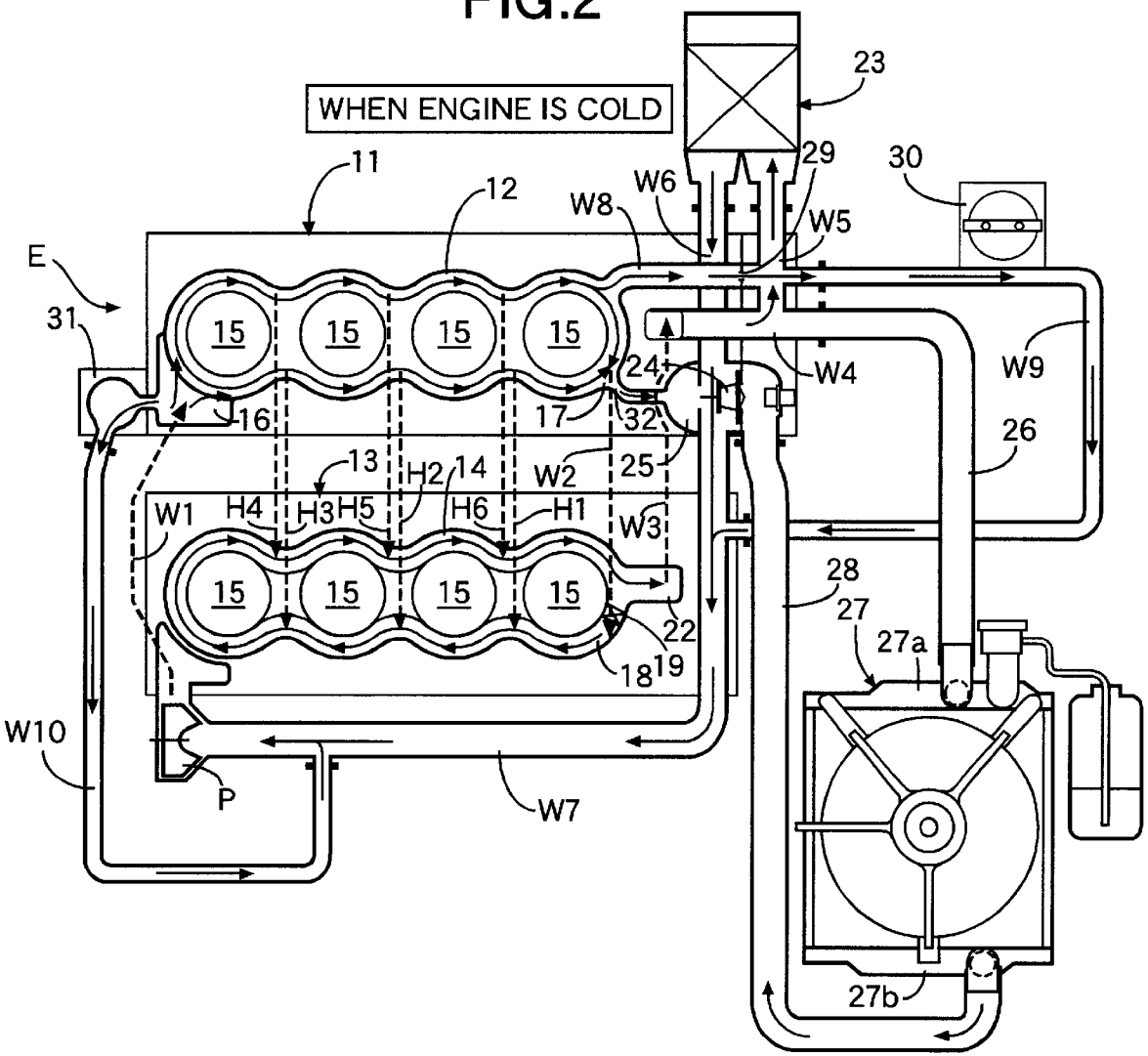
FIG. 2 is a circuit diagram of the cooling-water passages in the engine during closing of the thermostat.
Figure 3:
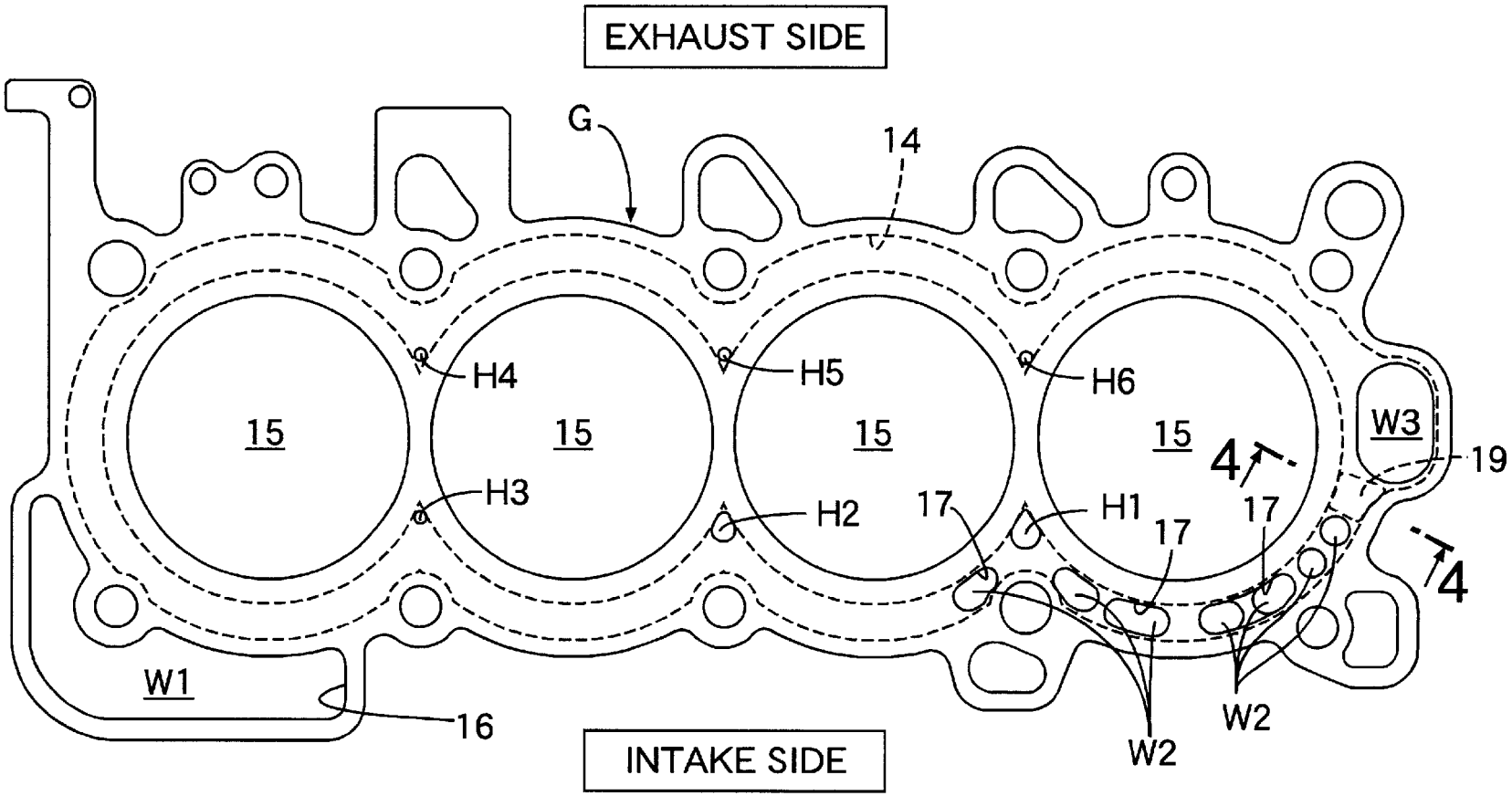
FIG. 3 is a view of a gasket mounted on parting faces of a cylinder block and a cylinder head, taken from the side of the cylinder head.
Figure 4:
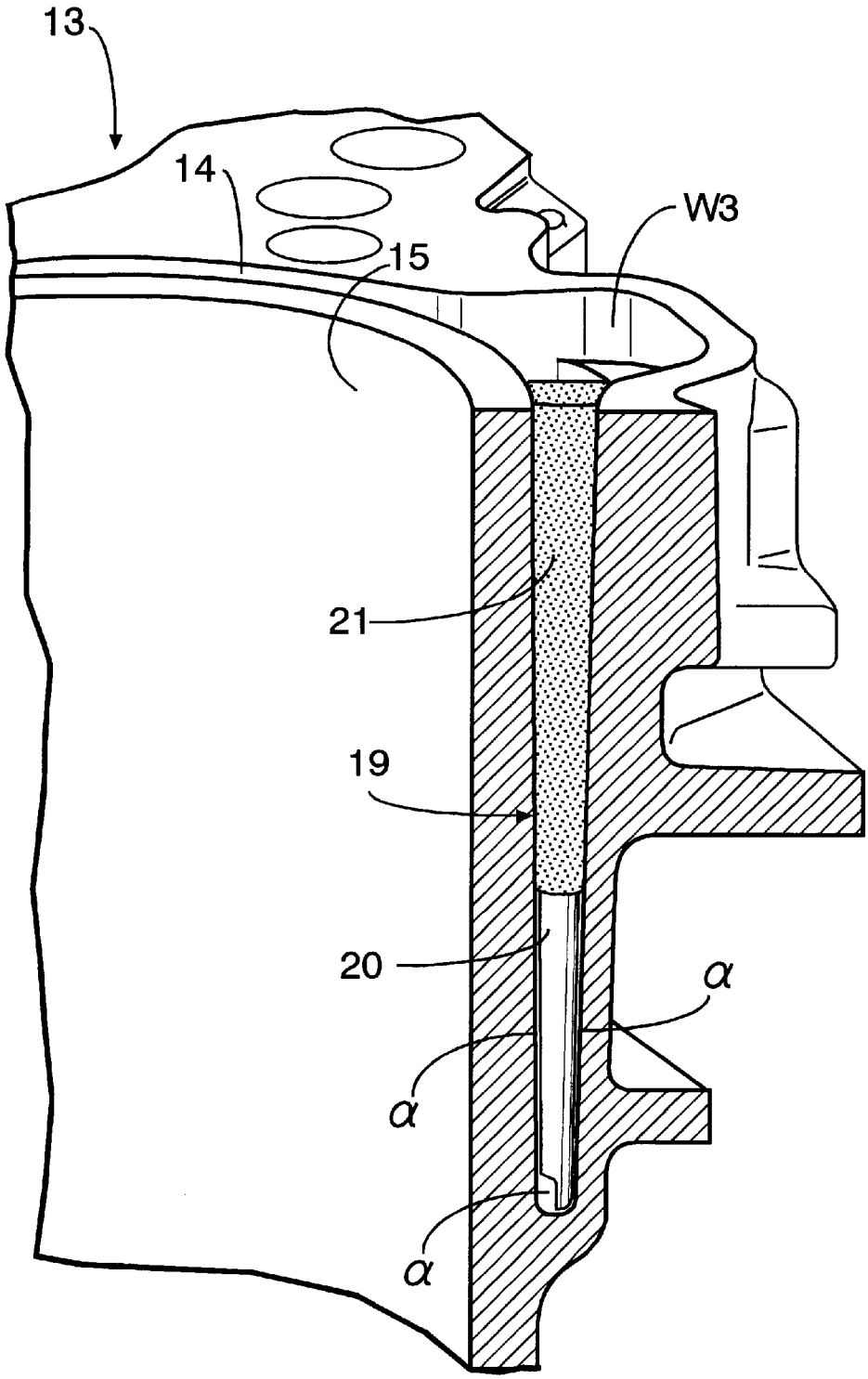
FIG. 4 is a sectional view taken along a line 4—4 in FIG. 3.
Figure 5:
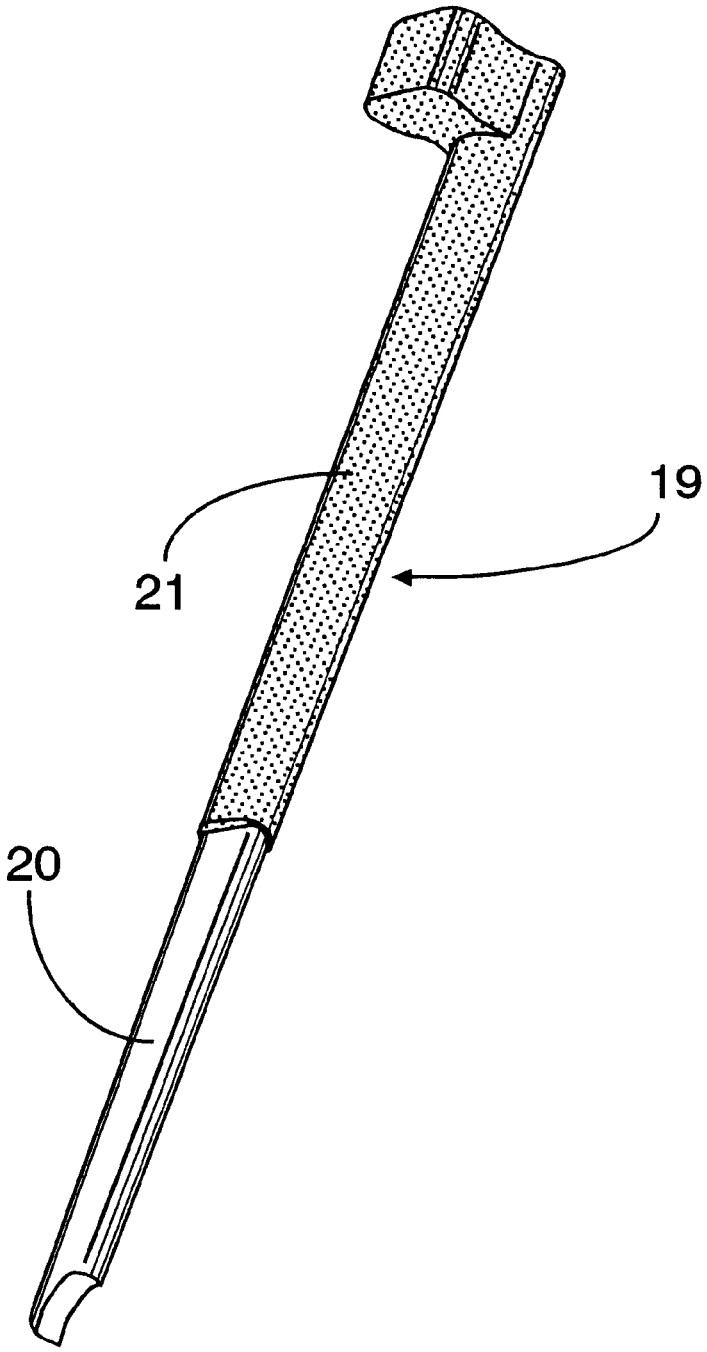
FIG. 5 is a perspective view of a shield member.

FIGS. 1 to 5 show an embodiment of the present invention. FIG. 1 is a circuit diagram of cooling-water passages in an engine during opening of a thermostat; FIG. 2 is a circuit diagram of the cooling-water passages in the engine during closing of the thermostat; FIG. 3 is a view of a gasket mounted on parting faces of a cylinder block and a cylinder head, taken from the side of the cylinder head; FIG. 4 is a sectional view taken along a line 4—4 in FIG. 3; and FIG. 5 is a perspective view of a shield member.

First, a cooling-water circuit in an in-line 4-cylinder engine E will be described below with reference to FIG. 1.

The engine E mounted on a vehicle includes a water jacket 12 in a cylinder head 11 and a water jacket 14 in a cylinder block 13. The water jacket 12 in the cylinder head 11 is defined to surround outer peripheries of four cylinders 15 disposed in series. The water jacket 14 in the cylinder block 13 is defined into an annular shape to surround all the outer peripheries of the four cylinders 15 disposed in series.

Cooling water exiting from a water pump P mounted at a lengthwise one end of the cylinder block 13 is supplied, through a first cooling-water passage W1 defined vertically in the cylinder block 13 and the cylinder head 11, to a cooling-water inlet 16 provided at a lengthwise one end of the water jacket 12 in the cylinder head 11. A plurality of cooling-water outlets 17 provided at the lengthwise other end of the water jacket 12 in the cylinder head 11 communicate with cooling-water inlets 18 provided in the lengthwise other end of the water jacket 14 in the cylinder block 13 through a second cooling-water passage W2 defined vertically in the cylinder head 11 and the cylinder block 13.

As can be seen from FIGS. 4 and 5, a rod-shaped shield member 19 is inserted into the lengthwise other end of the water jacket 14 in the cylinder block 13 from the mating face with the cylinder head 11. The shield member 19 comprises a core 20 made of a stainless steel, and the upper half of the shield member 19 is covered with an elastic material 21 (such as, a rubber). The elastic material 21 is in close contact with an inner surface of the water jacket 14, and a small gap a (see FIG. 4) is defined between the core 20 exposed from the elastic material 21 and the inner surface of the water jacket 14. The cooling-water inlets 18 of the water jacket 14 in the cylinder block 13 are located on one side of the shield member 19.

A cooling-water outlet 22 is provided in the lengthwise other end of the water jacket 14 in the cylinder block 13 on the side opposite from the cooling-water inlets 18 with respect to the shield member 19, and communicates with a heater core 23 for heating purpose through a third cooling-water passage W3 defined vertically in the cylinder block 13 and the cylinder head 11, a fourth cooling-water passage W4 being defined in the cylinder head 11 and a fifth cooling-water passage W5 being defined in the cylinder head 11.

A thermostat case 25 housing a thermostat 24 is mounted at the other end of the cylinder head 11, and communicates with the heater core 23 through a sixth cooling-water passage W6 and also communicates with a water pump P through a seventh cooling-water passage W7. The fourth cooling-water passage W4 in the cylinder head 11 communicates with an upper tank 27*a* of a radiator 27 through a first radiator hose 26. A lower tank 27*b* of the radiator 27 communicates with the thermostat case 25 through a second radiator hose 28. The communication between the second radiator 28 and the seventh cooling-water passage W7 is switched on and off by the thermostat 24.

A portion of the fourth cooling-water passage W4 in the cylinder head 11 is used commonly as a cooling-water passage for guiding the cooling water to the heater core 23 and a cooling-water passage for guiding the cooling water to the radiator 27. Therefore, a narrow space in the cylinder head 11 can be effectively utilized to contribute to a reduction in size of the engine E.

An eighth cooling-water passage W8 leading to the other end of the water jacket 12 in the cylinder head 11 intersects the fifth cooling-water passage W5. A flow rate-adjusting orifice 29 is provided at a location displaced from the intersection toward the cylinder head 11. A throttle body 30 is disposed in a ninth cooling-water passage W9 which connects a downstream end of the eighth cooling-water passage W8 and an intermediate portion of the seventh cooling-water passage W7 to each other, and is adapted to be warmed by the cooling water flowing through the ninth cooling-water passage W9, whereby a throttle butterfly is prevented from being frozen. An EGR cooler 31 leading to the cooling-water inlet 16 of the water jacket 12 in the cylinder head 11 is connected to the intermediate portion of the seventh cooling-water passage W7 through a tenth cooling-water passage W10.

The cooling-water outlets 17 of the water jacket 12 in the cylinder head 11 and the thermostat case 25 are connected to each other by a bypass passage 32 opened and closed by the thermostat 24.

As can be seen from FIGS. 1 and 3, six communication bores H1 to H6 are defined in a gasket G interposed between the cylinder block 13 and the cylinder head 11. The water jacket 12 in the cylinder head 11 and the water jacket 14 in the cylinder block 13 are put into communication with each other by the communication bores H1 to H6. The sizes of the communication bores H1 to H6 are set so that the sizes of the three communication bores H1 to H3 located on an intake side of the cylinder head 11 are not smaller than the size of the three communication bores H4 to H6 located on an exhaust side of the cylinder head 11. Among the three communication bores H1 to H3 located on the intake side, the size of the communication bore H1 most upstream in a direction of flow of the cooling water in the water jacket 14 in the cylinder block 13 is largest; and the sizes of the communication bores H2 and H3 more downstream are set sequentially smaller. The three communication bores H4 to H6 located on the exhaust side has the same size as the smallest communication bore H3 on the intake side.

The operation of the embodiment of the present invention having the above-described structural arrangement will be described below.

As shown in FIG. 2, when the warming-up of the engine E is not completed and the temperature of the cooling water is low, the thermostat 24 is in a closed state; the communication between the second radiator hose 28 for returning the cooling water from the radiator 27 and the inside of the thermostat case 25 is shut off, and the bypass passage 32 and the inside of the thermostat 25 communicate with each other. As a result, a circuit in which the cooling water flows from the fourth cooling-water passage W4 via the first radiator hose 26, the radiator 27 and the second radiator hose 28 to the thermostat 25, is closed; and most of the cooling water pumped by the water pump P is circulated through a closed circuit extending via: the first cooling-water passage W1→the cooling-water inlet 16 in the cylinder head 11→the water jacket 12 in the cylinder head 11→the cooling-water outlets 17 in the cylinder head 11→the second cooling-water passages W2→the cooling-water inlets 18 in the cylinder block 13→the water jacket 14 in the cylinder block 13→the cooling-water outlet 22 in the cylinder block 13→the third cooling-water passage W3→the fourth cooling-water passage W4→the fifth cooling-water passage W5→the heater core 23→the sixth cooling-water passage W6→the thermostat case 25→the seventh cooling-water passage W7, to return to the water pump P; thereby, promoting the warming-up of the engine E.

In this process, a portion of the cooling water is circulated to the thermostat case 25 through the bypass passage 32 opened by the thermostat 24. A portion of the cooling water diverted from the fifth cooling-water passage W5 to the ninth cooling-water passage W9, warms the throttle body 30 and is circulated to the seventh cooling-water passage W7. A portion of the cooling water diverted from the cooling-water inlet 16 in the cylinder head 11, cools the EGR cooler 31 and is then circulated via the tenth cooling-water passage W10 to the seventh cooling-water passage W7.

As shown in FIG. 1, when the warming-up of the engine E is completed and as a result, the temperature of the cooling water is raised sufficiently, the thermostat 24 is brought into an opened state, whereby the radiator hose 28 for returning the cooling water from the radiator 27 and the inside of the thermostat case 25 are put into communication with each other, and the communication between the bypass passage 32 and the inside of the thermostat case 25 is shut off. As a result, the circuit in which the cooling water flows from the fourth cooling-water passage W4 via the first radiator 26, the radiator 27 and the second radiator hose 28 to the thermostat case 25 is opened, whereby most of the cooling water pumped by the water pump P is circulated in a closed circuit extending via: the first cooling-water passage W1→the cooling-water inlet 16 in the cylinder head 11→the water jacket 12 in the cylinder head 11→the cooling-water outlets 17 in the cylinder head 11→the second cooling-water passages W2→the cooling-water inlets 18 in the cylinder block 13→the water jacket 14 in the cylinder block 13→the cooling-water outlet 22 in the cylinder block 13→the third cooling-water passage W3→the fourth cooling-water passage W4→the first radiator hose 26→the radiator 27→the second radiator hose 28→the thermostat case 25→the seventh cooling-water passage W7, to return to the water pump P; thereby, cooling the engine E.

In this process, a portion of the cooling water flows through the following path: the fourth cooling-water passage W4→the fifth cooling-water passage W5→the heater core 23→the sixth cooling-water passage W6→the thermostat case 25→the seventh cooling-water passage W7, to exert a heating function, but most of the cooling water flows through a path extending through the radiator 27; and hence, the flow rate of the cooling water flowing through the heater core 23 is reduced, as compared to when the engine is cold. However, a sufficient amount of cooling water supplied to the heater core 23 when the engine is hot, can be ensured by supplying a portion of the cooling water passed through the water jacket 12 in the cylinder head 11 through the orifice 29 of the eighth cooling-water passage W8 and the fifth cooling-water passage W5 to the heater core 23.

Also, when the engine is hot, a portion of the cooling water diverted from the fifth cooling-water passage W5 to the ninth cooling-water passage W9, warms the throttle body 30 and is circulated to the seventh cooling-water passage W7, and a portion of the cooling water diverted from the cooling-water inlet 16 in the cylinder head 11, cools the EGR cooler 31 and is then circulated via the tenth cooling-water passage W10 to the seventh cooling-water passage W7.

The cooling water exiting from the water pump P when the engine is hot, as described above, is supplied through the first cooling-water passage W1 defined vertically in the cylinder head 11 to the cooling-water inlet 16 in the cylinder head 11; and then flows therefrom through the water jacket 12 in the cylinder head 11 from the lengthwise one end to the other end of the water jacket 12, to cool the cylinder head 11; and thereafter, flows from the cooling-water outlets 17 in the cylinder head 11 through the plurality of second cooling-water passages W2 defined vertically in the cylinder head 11 and the cylinder block 13 into the cooling-water inlets 18 in the cylinder block 13.

In the water jacket 14 defined annularly in the cylinder block 13 to surround the four cylinders 15, its portion in the vicinity of the cooling-water inlets 18 located on the other end thereof is blocked up by the shield member 19 and hence, the cooling water flows in the water jacket 14 in a direction away from the shield member 19 (leftwards in FIG. 1) to cool a side face of the cylinder block 13 on the intake side. The cooling water, reaching one end of the water jacket 14 turns through 180° and flows in a direction toward the shield member 19 (rightwards in FIG. 1) to cool a side face of the cylinder block 13 on the exhaust side. The cooling water, which has flowed over the entire region of the water jacket 14 in the cylinder block 13, is discharged from the cooling-water outlet 22 provided at a location in front of the shield member 19 into the third cooling-water passage W3 defined in the cylinder block 13 and the cylinder head 11.

As described above, the substantially total amount of the low-temperature cooling water from the water pump P is supplied from the one end to the other end of the water jacket 12 in the relatively high-temperature cylinder head 11 to cool the cylinder head 11, and then supplied to the water jacket 14 in the relatively low-temperature cylinder block 13 to cool the cylinder block 13. Therefore, the cooling effect for the entire engine E can be enhanced. Moreover, the substantially total amount of the cooling water flows over the entire length of the annular water jacket 14 in the cylinder block 13 from one side toward the other side of the shield member 19 so that the cooling effect for the cylinder block 13 can be also enhanced.

In this process, the cooling water flowing in the water jacket 14 in the cylinder block 13 first flows along the side face on the intake side and then flows along the side face on the exhaust side. Therefore, the side face of the cylinder block 13 on the intake side can be effectively cooled, whereby the temperature rising in an intake air can be suppressed, leading to an enhancement in air intake efficiency so that a reduction in output from the engine E due to the temperature rising in intake air can be minimized.

Since the small gap $\alpha$ is defined between the core 20 of the shield member 19 and the inner surface of the water jacket 14, a portion of the cooling water supplied from the cooling-water inlets 18 flows through the gap $\alpha$ to a rear face of the shield member 19, whereby the stagnation of the cooling water on the rear face of the shield member 19 can be overcome.

In addition, the cooling water, which has cooled the water jacket 12 in the cylinder head 11 and the water jacket 14 in the cylinder block 13 to obtain the sufficiently raised temperature, is supplied to the heater core 23 so that the heater core 23 effectively exerts a heating effect.

Further, the flow rate of the cooling water flowing in the water jacket 12 in the cylinder block 11 can be reduced to promote the warming-up of the engine E by discharging a portion of the cooling water flowing in the water jacket 12 in the cylinder head 11 through the six communication bores H1 to H6 defined in the gasket G shown in FIG. 3 directly into the water jacket 14 in the cylinder block 13 when the engine is cold.

When the engine E is hot, the cooling effect for the cylinder block 13 is reduced because a portion of the cooling water is discharged through the communication bores H1 to H6 directly into the water jacket 14 in the cylinder block 13. This is because the cooling water flowing through the communication bores H1 to H6 into the water jacket 14 in the cylinder block 13 flows through a portion of the length of the water jacket 14, rather than over the entirety of the length of the water jacket 14, and is discharged from the cooling-water outlet 22.

In the present embodiment, however, the cooling water supplied from the communication bores H1 to H6 flows through a length as long as possible in the water jacket 14 in the cylinder block 13, whereby the cooling effect for the cylinder block 13 can be maximized, because the communication bore H1 farthest from the cooling-water outlet 22 in the water jacket 14 is largest in size; the communication bore H2 second farthest is second largest; and the communication bore H2 third farthest is third largest.

Although the embodiment of the present invention has been described in detail, it will be understood that various modifications in design may be made without departing from the subject matter of the present invention.

As discussed above, according to the first embodiment of the present invention, the cooling water from the water pump flows from the cooling-water inlet in the one end to the cooling-water outlet in the other end of the water jacket defined to extend along the opposite sides of the plurality of cylinders in the cylinder head. The cooling water is then supplied to the cooling-water inlet provided, on one side of the shield member, in the water jacket defined annularly in the cylinder block to surround the outer peripheries of the cylinders; and flows therefrom to the cooling-water outlet on the other side of the shield member. Therefore, the cylinder head having a relatively high temperature during operation of the engine is first cooled by a lower-temperature cooling water, and the cylinder block having a relatively low temperature is then cooled by the cooling water, whereby the cooling effect for the entire engine can be enhanced. More particularly, a substantially total amount of the cooling water flows over the entire region of the water jacket provided annularly in the cylinder block; thereby, leading to an enhancement in cooling effect for the cylinder block.

According to the second embodiment of the present invention, the upstream portion of the water jacket provided annularly in the cylinder block is disposed to extend along the side face of the cylinder block on the intake side; and the downstream portion is disposed to extend along the side face of the cylinder block on the exhaust side. Therefore, the side face of the cylinder block on the intake side can be preferentially cooled, whereby a reduction in intake efficiency can be minimized.

According to the third embodiment of the present invention, the cooling water exiting from the cooling-water outlet of the water jacket in the cylinder block is supplied to the heater core through the cooling-water passages defined in the cylinder block and the cylinder head. Therefore, the cooling water which has cooled both the cylinder head and the cylinder block to obtain a sufficiently raised temperature, can be supplied to the heater core, thereby enhancing the heating effect.

According to the fourth embodiment of the present invention, the cooling-water passage communicating with the heater core is partially used commonly as the cooling-water passage for supplying the cooling water to the radiator, which can contribute to an enhancement in space efficiency.

According to the fifth embodiment of the present invention, the water jacket in the cylinder head and the cooling-water passage communicating with the heater core are connected to each other by the cooling-water passage having the orifice. Therefore, when the engine is hot, even if the amount of the cooling water flowing in the radiator increases and the amount of the cooling water flowing in the heater core decreases, the heating ability can be maintained by supplying the cooling water from the water jacket in the cylinder head through the orifice directly to the heater core.

According to the sixth embodiment of the present invention, the water jackets in the cylinder head and the cylinder block are put into communication with each other by the communication bores defined between the opposed portions of the adjacent cylinders and hence, the opposed portions of the adjacent cylinders liable to have a high temperature can be cooled, but also the flow rate of the cooling water flowing in the water jacket in the cylinder when the engine is cold, can be decreased to promote the warming-up of the engine.

What is claimed is:

1. A cooling structure in an engine, in which cooling water from a water pump is supplied via a water jacket in a cylinder head to a water jacket in a cylinder block, wherein the water jacket in the cylinder head is defined to extend along opposite sides of a plurality of cylinders disposed in a row, and has a cooling-water inlet and a cooling-water outlet provided at lengthwise one end thereof and the lengthwise other end thereof, respectively; and wherein the water jacket in the cylinder block is annularly defined to surround outer peripheries of the plurality of cylinders disposed in the row, and is shielded at one point by a shield member, has a cooling-water inlet provided on one side of the shield member to communicate with the cooling-water outlet in the water jacket in the cylinder head, and has a cooling-water outlet provided in the other side of the shield member.

2. A cooling structure in an engine according to claim 1, wherein in the water jacket in the cylinder block, its portion upstream in a direction of flow of the cooling water is disposed to extend along a side face of the cylinder block on an intake side, and its portion downstream in the direction of flow of the cooling water is disposed to extend along a side face of the cylinder block on an exhaust side.

3. A cooling structure in an engine according to claim 1 or 2, wherein the cooling-water outlet of the water jacket in the cylinder block communicates with a heater core through cooling-water passages defined in the cylinder block and the cylinder head.

4. A cooling structure in an engine according to claim 3, wherein a portion of the cooling-water passage communicating with the heater core is used commonly as a cooling-water passage for supplying the cooling water to a radiator.

5. A cooling structure in an engine according to claim 1 or 2, wherein the water jacket in the cylinder head and the cooling-water passage communicating with the heater core are connected to each other by a cooling-water passage having an orifice.

6. A cooling structure in an engine according to claim 1 or 2, wherein the water jacket in the cylinder head and the water jacket in the cylinder block are put into communication with each other by communication bores defined between opposed portions of the adjacent cylinders.

* * * * *